US007036695B1

(12) United States Patent
Frye

(10) Patent No.: US 7,036,695 B1
(45) Date of Patent: May 2, 2006

(54) GARMENT HANGER

(76) Inventor: Betty F. Frye, 3245 Mull Creek La., Claremont, NC (US) 28610

( * ) Notice: Subject to any disclaimer, the term of this patent is extended or adjusted under 35 U.S.C. 154(b) by 380 days.

(21) Appl. No.: 10/413,190

(22) Filed: Apr. 14, 2003

(51) Int. Cl.
*A41D 27/22* (2006.01)

(52) U.S. Cl. ..... 223/89; 223/94

(58) Field of Classification Search ..... 223/87, 223/85, 94, 89
See application file for complete search history.

(56) References Cited

U.S. PATENT DOCUMENTS

| | | | | |
|---|---|---|---|---|
| D91,319 | S | 1/1934 | Falk | |
| 2,058,217 | A | 10/1936 | Dixon | |
| 2,191,714 | A | 2/1940 | Gustin | |
| 2,192,167 | A | 3/1940 | Bagley et al. | |
| 2,451,552 | A | 10/1948 | Hayward | |
| 2,498,400 | A | 2/1950 | DuLude | |
| 2,523,682 | A | 9/1950 | Corwin | |
| 2,594,966 | A | 4/1952 | McKinney | |
| 2,598,315 | A | 5/1952 | Sweet | |
| 2,709,006 | A | 5/1955 | Ludwig | |
| 2,755,013 | A | 7/1956 | Beede | |
| 2,822,967 | A | 2/1958 | Spitz | |
| 3,037,621 | A | 6/1962 | Jackman | |
| 3,061,154 | A * | 10/1962 | Connall | 223/87 |
| 3,123,263 | A * | 3/1964 | Jang | 223/87 |
| 3,462,068 | A | 8/1969 | Suominen | |
| 3,469,679 | A | 9/1969 | Kamins et al. | |
| 3,486,683 | A | 12/1969 | Kamins et al. | |
| 3,542,170 | A | 11/1970 | Bialo | |
| 3,651,999 | A | 3/1972 | Fiocca | |
| 3,692,269 | A | 9/1972 | Hales | |
| 3,746,222 | A | 7/1973 | Tiss | |
| 3,783,995 | A | 1/1974 | Tobin | |
| 3,809,194 | A | 5/1974 | Chappelle et al. | |
| 3,900,181 | A | 8/1975 | Pitanis | |
| 3,945,500 | A | 3/1976 | Meckstroth | |
| 3,997,091 | A | 12/1976 | Burnette | |
| 3,999,656 | A | 12/1976 | Hydorn | |
| 4,189,049 | A | 2/1980 | Silver | |
| 4,219,140 | A | 8/1980 | Siminoff | |
| 4,266,677 | A | 5/1981 | Dewsnap | |
| 4,366,909 | A | 1/1983 | Fahmi | |
| 4,474,316 | A | 10/1984 | Philibert | |
| 4,593,812 | A | 6/1986 | Dillingham | |
| 4,601,417 | A | 7/1986 | Kunreuther | |

(Continued)

FOREIGN PATENT DOCUMENTS

| | | |
|---|---|---|
| FR | 2261933 | 9/1975 |

(Continued)

OTHER PUBLICATIONS

Conover Plastics, Inc. brochure (undated) 2 pages.

(Continued)

*Primary Examiner*—Gary L. Welch

(57) ABSTRACT

A garment hanger is provided for supporting socks or other garments on a conventional display panel having extending display rods. The garment hanger has a planar configuration before folding and includes first and second supports which are spaced by a thin, flexible connector having elongated members which readily bend to allow the supports to sandwich a garment therebetween. A conventional plastic tack is passed through apertures in the supports and through the garment to maintain the garment and hanger together. In the method of affixing the garment to the hanger a catch positioned on the first support moves from a parallel or coplanar position to an angled, erect disposition for convenience in suspending the garment hanger from the display rod.

26 Claims, 3 Drawing Sheets

U.S. PATENT DOCUMENTS

| | | | |
|---|---|---|---|
| 4,718,546 | A | 1/1988 | Kolton et al. |
| 4,759,440 | A | 7/1988 | Kolton et al. |
| 4,765,467 | A | 8/1988 | Kolton et al. |
| 4,768,649 | A | 9/1988 | Kolten et al. |
| 5,014,957 | A | 5/1991 | Nichol, Jr. |
| 5,027,945 | A | 7/1991 | Wilkins |
| 5,127,559 | A | 7/1992 | Freer et al. |
| 5,161,720 | A | 11/1992 | Kolton et al. |
| 5,857,597 | A | 1/1999 | Kolton |
| 6,006,964 | A | 12/1999 | White |
| 6,170,679 | B1 | 1/2001 | Frye et al. |
| 6,349,863 | B1 | 2/2002 | Frye |

FOREIGN PATENT DOCUMENTS

| | | |
|---|---|---|
| FR | 2399365 | 3/1979 |

OTHER PUBLICATIONS

Drawings from applicant's previous pending U.S. Appl. No. 09/928,067, filed Aug. 13, 2001 which has since been abandoned.
Pictures of Avery Dennison System 1000 Tools; hand tool for attaching fasteners, undated.
Picture of Avery Dennison Tool, undated.
Picture of fastener types and sizes, undated.

* cited by examiner

GARMENT HANGER

FIELD OF THE INVENTION

The invention herein pertains to garment hangers and particularly pertains to garment hangers for small clothing and related articles such as socks, handkerchiefs, belts or the like for display in retail and other stores.

DESCRIPTION OF THE PRIOR ART AND OBJECTIVES OF THE INVENTION

In recent years garment hangers for displaying small clothing and other articles have become increasingly popular. Such hangers generally include a hook-like catch for suspending the article from a display board, peg or rod which supports multiple hangers. Such hangers allow the consumers to easily observe, inspect, and handle the articles without damage or removal from the hanger. However, hangers in the past have often failed, allowing the articles to partially or completely slip therefrom where they can become soiled and unattractive to the potential buyer. Some garment hangers used in the past are difficult, expensive and complicated to manufacture while other hangers are easy to manufacture but are labor intensive when attaching an article thereto.

Thus with the disadvantages and problems associated with certain conventional garment display hangers, the present invention was conceived and one of its objectives is to provide a garment hanger for displaying articles which can be easily manufactured such as by molding at a relatively low cost.

It is still another objective of the present invention to provide a garment hanger which can be used with single or multiple clothing or other articles.

It is yet another objective of the present invention to provide a display hanger in which clothing or other articles can be securely attached with minimal labor.

It is also another objective of the present invention to provide a garment hanger which utilizes a conventional tack to secure the article thereto.

It is still another objective of the present invention to provide a method for affixing a garment or other article to a display hanger whereby the hanger is folded from a flat or planar posture to surround and sandwich the article therein and then secured with a standard polymeric tack.

Various other objectives and advantages of the present invention will become apparent to those skilled in the art as a more detailed description is set forth below.

SUMMARY OF THE INVENTION

The aforesaid and other objectives are realized by providing a relatively flat, planar foldable garment hanger formed from a conventional polymeric material such as polypropylene by injection or other standard molding processes. The hanger includes first and second garment supports which are spaced apart by a flexible connector. Affixed to one of the garment supports is a hook-like catch which extends in coplanar relation along the connector before folding.

In use, the hanger is placed on a standard tack gun barrel using an aperture on one of the supports. A clothing article is then placed on the barrel and the other support is then folded thereon by bending the flexible connector. A conventional plastic tack is then driven through the supports and clothing article for securement. During folding of the hanger the catch moves from a coplanar relation with the supports and assumes an upright posture angular to the connector, thus exposing the catch and allowing the garment hanger to be easily positioned by the catch on a standard display rod. The consumer can remove the hanger from the garment or other article contained therein by severing the tack to thus free the article. The garment hanger can then be disposed as usual.

DETAILED DESCRIPTION OF THE PREFERRED EMBODIMENT AND OPERATION OF THE INVENTION

Figure 5:
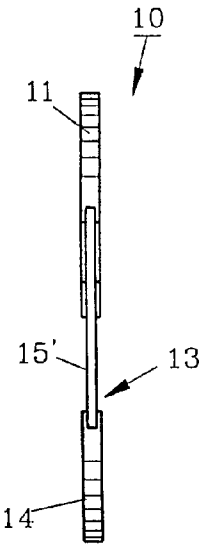
FIG. 5 is a left end view of the garment hanger as shown in FIG. 2.
Figure 4:
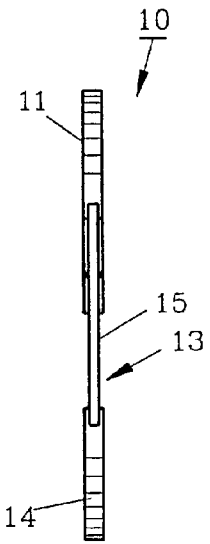
FIG. 4 is a right end view of the garment hanger shown in FIG. 2.
Figure 1:
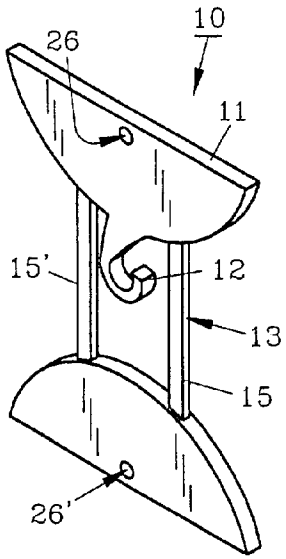
FIG. 1 shows a front, top, right end perspective view of the preferred form of the garment hanger of the invention.

For a better understanding of the invention and its operation, turning now to the drawings, preferred garment hanger 10 as shown in FIGS. 1–7 is molded from conventional polypropylene although other polymers or materials may be used. Garment hanger 10 is formed substantially planar as seen in FIG. 1 and includes first support section 11 integrally formed as by standard molding techniques with hook-like catch 12. First support 11 is attached to second support 14 by flexible connector 13 which includes thin, flexible elongated members 15, 15'. Elongated members 15, 15' have preferably a rectangular cross section, are parallel, and are coplanar with first support 11 and second support 12 as shown in FIGS. 4 and 5 in unfolded form. Catch 12 is likewise coplanar with first support 11 and second support 14 when flat or unfolded as also seen in FIGS. 4 and 5. First garment support 11, second garment support 14 and catch 12 have a thickness preferably of 70 gauge (0.07 in.) whereas flexible, elongated connectors 15, 15' are thinner and have a thickness as shown in FIGS. 4–7 of 35 gauge (0.035 in.) for ease in bending. Supports 11, 14 preferably have an arcuate upper surface, but other shapes and configurations could be used.

Figure 2:
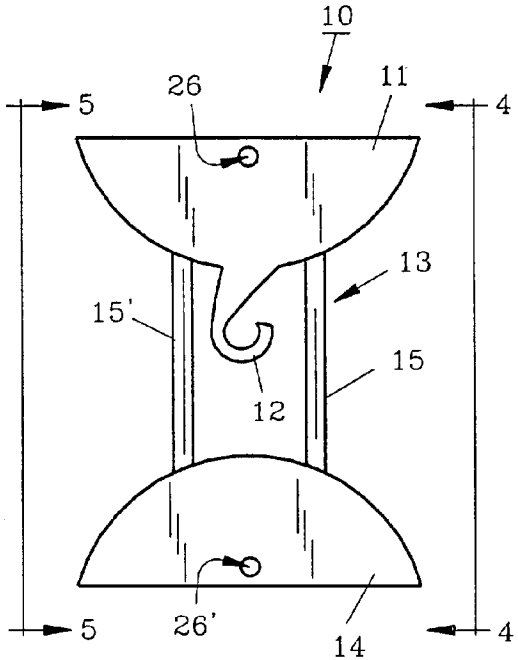
FIG. 2 is a front elevational view of the garment hanger as shown in FIG. 1.
Figure 3:
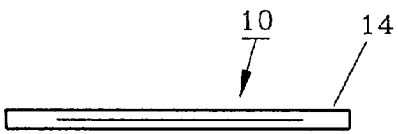
FIG. 3 is a bottom plan view of the garment hanger shown in FIG. 2.
Figure 7:
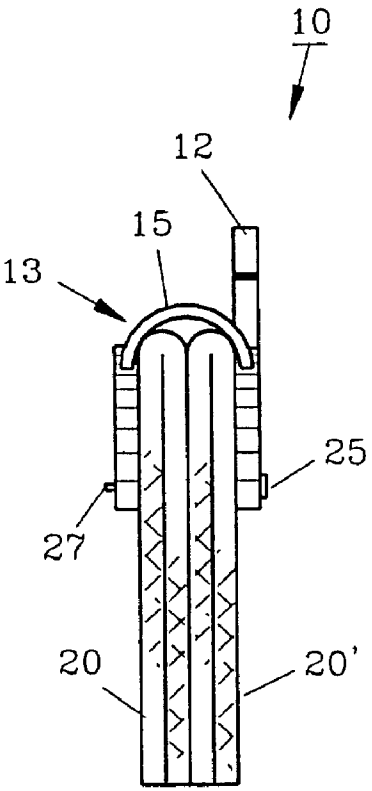
FIG. 7 illustrates the garment hanger as shown in FIG. 6 but with a pair of garments therein.
Figure 6:
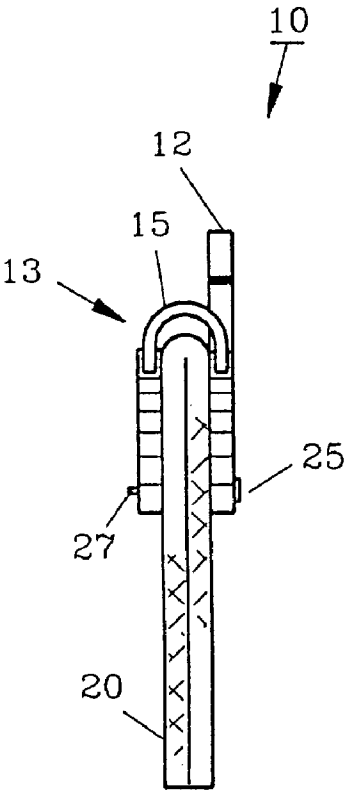
FIG. 6 shows a right end view of the garment hanger of FIG. 2 which has been folded and tacked to accommodate a garment.
Figure 8:
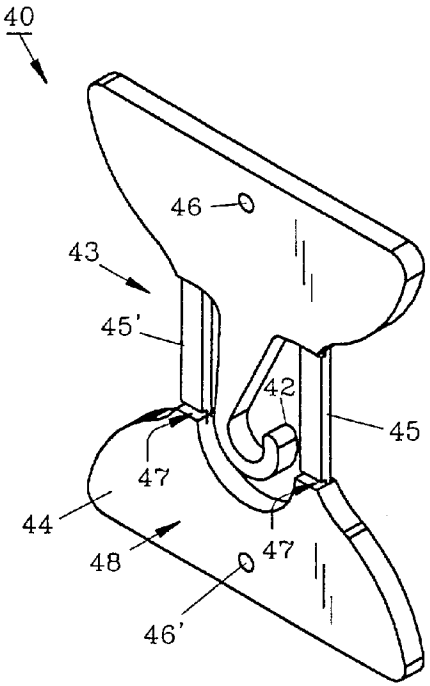
FIG. 8 features an enlarged, top, right-end perspective view of an alternative embodiment of the invention in unfolded form.

In FIGS. 1–5, garment hanger 10 is shown in its relaxed or unfolded posture whereas in enlarged FIG. 8, alternate garment hanger 40 is shown in a folded posture, without a garment therein. In FIG. 6, garment hanger 10 has been folded to support garment 20 which may be a sock, tie, handkerchief or the like whereas in FIG. 7 a pair of garments 20, 20' are retained by garment hanger 10. To secure garments 20, 20' therein, conventional plastic tack 25 is positioned and "shot" through apertures 26, 26' as shown in FIGS. 1 and 2 as is conventional in the trade. Once tack 25 passes through garments 20, 20' it is secure within hanger 10. Tack 25 is one of many standard tacks that could be used as manufactured by Avery Dennison of 50 Pointe Drive, Brea, Calif. 92821.

The preferred method of hanging garments such as socks, belts or the like comprises the steps of selecting a garment hanger such as garment hanger 10 shown in FIG. 2 and placing it on a needle barrel of a standard tack gun (such as Avery Dennison's Bench Mount System 1000®) properly mounted in stable fashion (not shown). A garment, such as garment 20 shown in FIG. 6 is then placed on the gun needle barrel against hanger 10. Next, hanger 10 is folded onto garment 20 by bending flexible connector 13 whereby tack apertures 26, 26' are then coincidentally aligned on each side of garment 20. Next, tack 25 is then driven through apertures 26, 26' and garment 20 which is disposed therebetween by firing the tack gun. Terminal end 27 of tack 25 prevents inadvertent tack 25 removal. Conventional plastic tacks are preferred, through metal tacks, yarn or the like could be used. As first garment support 11 is folded over, catch 12 becomes angularly disposed to connector 13 as shown in FIGS. 6 and 7. Catch 12, which is then erect and clear of connector 13 can be used to suspend garment hanger 10 and garment 20 on a conventional display peg or rod on a retail store display board or otherwise.

Figure 9:
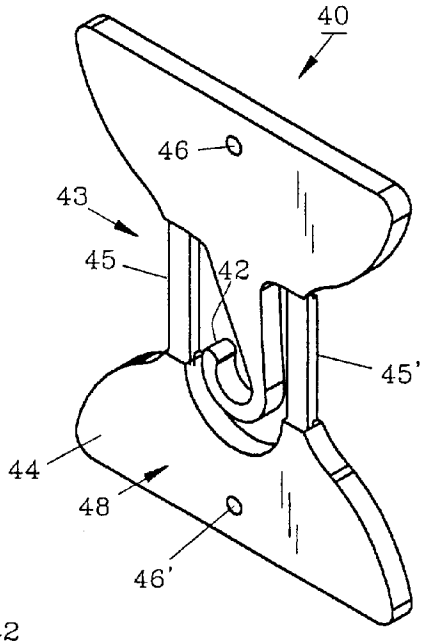
FIG. 9 demonstrates a mirror image of the invention as seen in FIG. 8.
Figure 10:
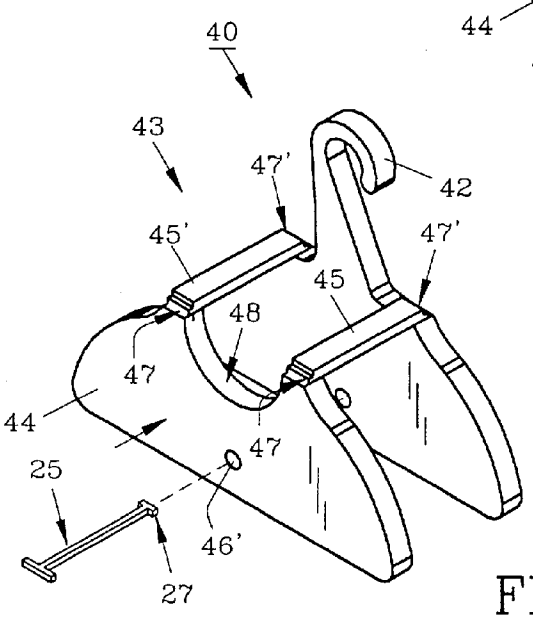
FIG. 10 depicts a perspective view of the garment hanger as shown in FIGS. 8 and 9 after folding, but without a garment therein.

An alternate embodiment of the invention is shown in FIGS. 8, 9 and 10 with garment hanger 40 having a relatively short connector 43. Connector 43 includes rectangular shaped elongated members 45, 45' which include hinges 47, 47' at each end thereof. Hinges 47, 47' have a thickness approximately one-half that of connectors 45, 45' to easily bend and allow connector 43 to assume a flatter posture against socks or other garments when folded as shown in FIG. 10. Top depression 48 of garment support 44 accommodates hook-like catch 42 when garment hanger 40 is in a planar or unfolded posture as shown in FIGS. 8 and 9. As would be understood, the top or outer view is seen of garment hanger 40 shown in FIG. 8 whereas the bottom or inner side would appear as a mirror image thereof as seen in FIG. 9.

As would be understood, a tack such as tack 25 is driven through aperture 46', the garment placed therebeside and coincidentally aligned with aperture 46 (FIG. 8) to secure hanger 40 to the particular garment (not shown) in FIG. 10. This method of attachment is fully described above regarding preferred garment hanger 10.

The illustrations and examples provided herein are for explanatory purposes and are not intended to limit the scope of the appended claims.

I claim:

1. A foldable garment hanger comprising: a first garment support, a second garment support, a flexible connector, said flexible connector attached to said first and said second garment supports, said flexible connector comprising a first elongated member, said first elongated member for spacing said first and second garment supports from one another by the length of said flexible connector when said hanger is unfolded, a catch, said catch attached to said first garment support and extending toward said second garment support while said garment hanger is in an unfolded posture, whereby upon folding said hanger to maintain a garment therein said connector and said catch are relatively angularly disposed to each other.

2. The foldable garment hanger of claim 1 wherein said first and said second garment supports each define a tack aperture.

3. The foldable garment hanger of claim 2 further comprising a tack, said tack positioned in said first and said second garment support apertures.

4. The foldable garment hanger of claim 1 wherein said flexible connector comprises a second elongated member.

5. The foldable garment hanger of claim 4 wherein each of said flexible connector members has a rectangular cross section.

6. The foldable garment hanger of claim 5 wherein said flexible connector members are parallel.

7. The foldable garment hanger of claim 4 wherein said catch is located between said first and said second elongated members.

8. The foldable garment hanger of claim 1 wherein said second garment support has an arcuate outer shape.

9. A garment hanger foldable from a planar posture to maintain a garment thereon comprising: a first garment support, a second garment support, said first garment support spaced from said second garment support, a flexible connector, said flexible connector comprising a first elongated member, said flexible connector attached to said first and said second garment supports, whereby said first garment support is spaced from said second garment support by the length of said flexible connector when said hanger is unfolded and upon folding said hanger along said connector said catch will extend angularly to said connector.

10. The foldable garment hanger of claim 9 formed from a polymeric material.

11. The foldable garment hanger of claim 10 wherein said polymeric material is polypropylene.

12. The foldable garment hanger of claim 9 wherein said flexible connector further comprises a second elongated member, said second elongated member spaced from said first elongated member.

13. The foldable garment hanger of claim 9 further comprising a catch, said catch attached to said first garment support proximate said flexible connector.

14. The foldable garment hanger of claim 13 wherein said catch is positioned between said pair of elongated members.

15. The foldable garment hanger of claim 13 wherein said catch is positioned between said pair of elongated members and is coplanar therewith when said hanger is unfolded.

16. The foldable garment hanger of claim 9 wherein said first and said second garment supports each define a tack aperture, a tack, and said tack positioned in said first and said second tack apertures to maintain said garment hanger in a folded posture.

17. A garment hanger formed from a polymeric material foldable from a planar posture to maintain a garment thereon comprising: a first garment support, a second garment support, said first garment support spaced from said second garment support, a flexible connector, said flexible connector attached to said first and said second garment supports, a catch, said catch attached to said first garment support proximate said flexible connector whereby upon folding said hanger along said flexible connector said catch will extend angularly to said flexible connector.

18. The foldable garment hanger of claim 17 wherein said flexible connector further comprises a first hinge and a second hinge, each one of said hinges affixed to a different end of said flexible connector, said first hinge attached to said first garment support, said second hinge attached to said second garment support whereby said pair of hinges permit said flexible connector to remain substantially linear when said hanger is folded.

19. The foldable garment hanger of claim 17 wherein said flexible connector further comprises a first elongated member whereby said first garment support is spaced from said second garment support by the length of said flexible connector when said hanger is unfolded.

20. The foldable garment hanger of claim 19 wherein said flexible connector further comprises a second elongated member, said catch positioned between said first and said second elongated members.

21. The foldable garment hanger of claim 17 wherein said first and said second garment supports each define a tack aperture, a tack, said tack positioned in said first and said second tack apertures to maintain said garment hanger in a folded posture.

22. A garment hanger foldable from a planar posture to maintain a garment thereon comprising: a first garment support, a second garment support, said first garment support spaced from said second garment support, a flexible connector, said flexible connector attached to said first and said second garment supports for spacing said first garment support from said second garment support by the length of said flexible connector, said flexible connector further comprising a first hinge and a second hinge, each one of said hinges affixed to a different end of said flexible connector, said first hinge attached to said first garment support, said second hinge attached to said second garment support whereby said pair of hinges permit said flexible connector to remain substantially linear when said hanger is folded.

23. The foldable garment hanger of claim 22 further comprising a catch, said catch attached to said first garment support proximate said flexible connector whereby upon folding said hanger along said flexible connector said catch will extend angularly to said flexible connector.

24. The foldable garment hanger of claim 22 wherein said flexible connector further comprises a first elongated member whereby said first garment support is spaced from said second garment support by the length of said flexible connector when said hanger is unfolded.

25. The foldable garment hanger of claim 24 wherein said flexible connector further comprises a second elongated member, said second elongated member spaced from said first elongated member.

26. The foldable garment hanger of claim 22 wherein said first and said second garment supports each define a tack aperture, a tack, said tack positioned in said first and said second tack apertures to maintain said garment hanger in a folded posture.

* * * * *